US005545464A

United States Patent [19]

Stokes

[11] Patent Number: 5,545,464

[45] Date of Patent: Aug. 13, 1996

[54] CONJUGATE FIBER NONWOVEN FABRIC

[75] Inventor: Ty J. Stokes, Suwanee, Ga.

[73] Assignee: Kimberly-Clark Corporation, Neenah, Wis.

[21] Appl. No.: 408,458

[22] Filed: Mar. 22, 1995

[51] Int. Cl.[6] ..... D04H 3/14; D04H 3/16

[52] U.S. Cl. ..... 428/198; 2/2; 2/114; 2/901; 128/849; 428/221; 428/296; 428/311.1; 428/373

[58] Field of Search ..... 2/2, 114, 901; 428/198, 221, 311.1, 373, 296; 128/849

[56] References Cited

U.S. PATENT DOCUMENTS 3,911,499 10/1975 Benevento et al. ..... 2/114
4,535,481 8/1985 Ruth-Larson et al. ..... 2/114
4,717,325 1/1988 Fujimura et al. ..... 425/131.5
5,165,979 11/1992 Watkins et al. ..... 428/113
5,202,185 4/1993 Samuelson ..... 428/373

*Primary Examiner*—James C. Cannon
*Attorney, Agent, or Firm*—Michael U. Lee

[57] ABSTRACT

The present invention provides a pattern bonded nonwoven fabric containing conjugate fibers. The conjugate fibers contain a higher melting component polymer and a lower melting component polymer, wherein the higher melting component polymer envelopes the lower melting component polymer and forms the peripheral surface along the length of the fibers. The present invention also provides articles produced from the conjugate fiber fabric.

20 Claims, 4 Drawing Sheets

CONJUGATE FIBER NONWOVEN FABRIC

BACKGROUND OF THE INVENTION

The present invention is related to conjugate fibers and nonwoven fabrics made therefrom. More particularly, the invention is related to conjugate fibers, which contain at least two olefin polymers having different melting points, and pattern bonded nonwoven fabrics made therefrom.

Pattern bonded nonwoven fabrics produced from thermoplastic fibers are known in the art and have found uses in a variety of applications, especially in disposable articles. A pattern bonded nonwoven fabric contains a pattern of bonded points or regions in which the fibers in the bonded regions are compacted under heat and pressure to autogenously fuse the polymer exposed on the surface of the fibers and form interfiber bonds. Although nonwoven fabrics are highly suitable for many applications, they tend to be stiff and paper-like when compared to woven textile fabrics of similar basis weight. The stiff property of nonwoven fabrics is perceived to be disadvantageous, particularly, in applications where the fabric comes in contact with the human skin, such as surgical drapes, diapers, sanitary napkins, incontinence care products and disposable garments. Many attempts have been made to produce soft nonwoven fabrics, e.g., changing bond patterns, incorporating a softening agent in the composition of nonwoven fabrics and applying a topical softening agent on nonwoven fabrics. For example, U.S. Pat. No. 3,855,046 to Hansen et al. teaches a point bonded soft and drapable nonwoven fabric that contains releasably bonded regions. U.S. Pat. No. 3,973,068 to Weber teaches a soft nonwoven web that is produced from a thermoplastic polymer composition containing a latent lubricant. The presence of the lubricant reduces the tendency of secondary bond formation outside the bonding regions during the bonding process and results in improved softness and drapability without adversely affecting web strength properties.

Another approach known in the art for producing a soft nonwoven fabric is fabricating a nonwoven fabric from crimped conjugate fibers. Such crimped conjugate fibers contain at least two component polymers that occupy distinct cross-sections of the fibers, typically in a side-by-side configuration. In general, the component polymers for crimped conjugate fibers are selected from polymers having different shrinkage properties, thereby the shrinkage differential between the component polymers causes crimps in the fibers during or subsequent to the fiber spinning process. Typically, the component polymers additionally are selected to have different melting points, and the lowest melting polymer thereof is exposed on the peripheral surface along the entire length of the fibers. The exposed low melting polymer is utilized to improve the bondability of nonwoven webs produced from such conjugate fibers. After the conjugate fibers are deposited or carded to form a nonwoven web, the exposed lowest melting polymer is utilized to form interfiber bonds, especially at crossover contact points of the fibers. When the fabric is heat treated to a temperature above the melting point of the lowest melting polymer but below the melting point of the other component polymers of the fibers, the lowest melting polymer is rendered tacky or adhesive and forms interfiber bonds while the other component polymers maintain the physical integrity of the nonwoven fabric. However, the bondability of such conjugate fiber fabric is improved at the expense of other properties including abrasion resistance since the bond points formed from the lowest melting component polymer tend to exhibit a lower abrasion resistance than those formed from higher melting polymers.

Although the above-described approaches of producing soft, drapable nonwoven fabrics are highly useful, there still remains a need to produce a bonded nonwoven fabric that has improved desirable properties, such as softness, drapability, abrasion resistance and the like, and that does not require additional manufacturing steps to attain such desirable properties.

SUMMARY OF THE INVENTION

The present invention provides a pattern bonded nonwoven fabric containing conjugate fibers. The conjugate fibers contain a higher melting component polymer and a lower melting component polymer, wherein the higher melting component polymer envelops the lower melting component polymer and forms the peripheral surface along the length of the fibers. Desirably, the higher melting component polymer is selected from olefin polymers, polyamides, polyesters and blends thereof; and the lower melting polymer is selected from olefin polymers. The nonwoven fabric has a basis weight between about 5 $g/m^2$ and about 170 $g/m^2$, desirably between about 10 $g/m^2$ and about 100 $g/m^2$. The present invention also provides articles produced from the conjugate fiber fabric.

The term "fibers" as used herein refers to both staple length fibers and continuous filaments, unless otherwise indicated. The term "spunbond fiber nonwoven fabric" refers to a nonwoven fiber fabric of small diameter filaments that are formed by extruding a molten thermoplastic polymer as filaments from a plurality of capillaries of a spinneret. The extruded filaments are cooled while being drawn by an eductive or other well-known drawing mechanism. The drawn filaments are deposited or laid onto a forming surface in a random, isotropic manner to form a loosely entangled fiber web, and then the laid fiber web is subjected to a bonding process to impart physical integrity and dimensional stability. The production of spunbond fabrics is disclosed, for example, in U.S. Pat. No. 4,340,563 to Appel et al. and 3,692,618 to Dorschner et al. Typically, spunbond fibers have an average diameter in excess of 10 μm and up to about 55 μm or higher, although finer spunbond fibers can be produced. The term "staple fibers" refers to discontinuous fibers, which typically have an average diameter similar to or somewhat smaller than that of spunbond fibers. Staple fibers are produced with a conventional fiber spinning process and then cut to a staple length, from about 1 inch to about 8 inches. Such staple fibers are subsequently carded or air-laid and thermally or adhesively bonded to form a nonwoven fabric.

DETAILED DESCRIPTION OF THE INVENTION

Figure 1:
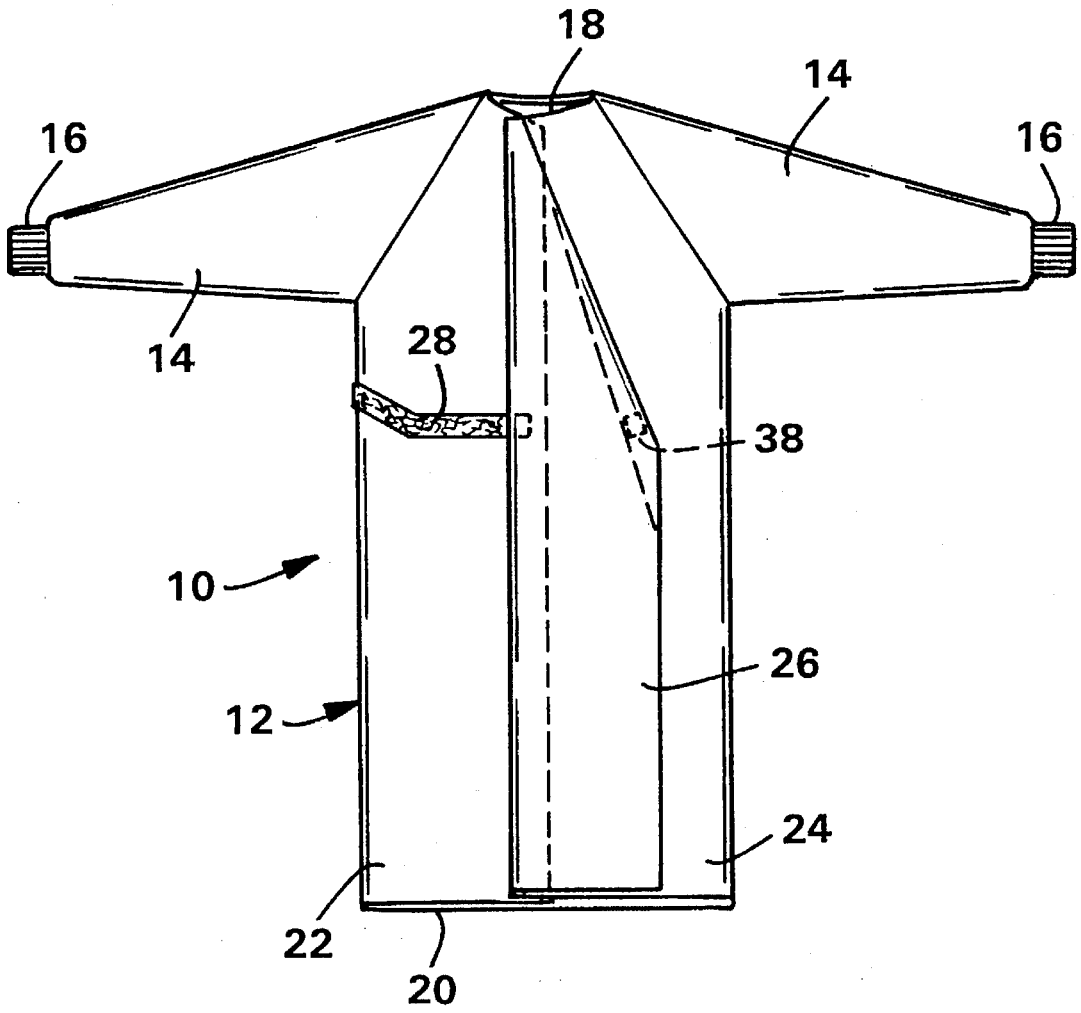
FIG. 1 illustrates an exemplary article produced from the present conjugate fiber fabric.

The present invention provides a soft, drapable pattern bonded nonwoven fabric of conjugate fibers. Although the present conjugate fibers may contain more than two component polymers, the present invention is described hereinafter with two-component (bicomponent) conjugate fibers for illustration purpose. The conjugate fibers contain a higher melting component polymer and a lower melting component polymer. The present conjugate fibers forming the nonwoven fabric may be characterized as having a conjugate fiber configuration in which the higher melting component polymer completely encloses the lower melting component polymer and forms the peripheral surface along the length of the fibers. The pattern bonded nonwoven fabric of the present invention exhibits improved softness, feel and drapability without measurably affecting abrasion resistance when compared to pattern bonded nonwoven fabrics that are produced from monocomponent fibers containing the higher melting component polymer of the conjugate fibers. Additionally, compared to pattern bonded conjugate fiber nonwoven fabrics containing conventional conjugate fibers of a lower melting polymer sheath and a higher melting polymer core, the present conjugate fiber nonwoven fabric exhibits highly improved abrasion and scuff resistance and has a significantly expanded use temperature range. The present conjugate fiber fabric, which has a higher melting polymer sheath, has a use temperature range that is similar to monocomponent fiber fabrics that are produced from the higher melting sheath polymer, while providing improved properties such as softness and hand. It is believed that the higher melting polymer sheath of the present conjugate fibers contains the lower melting polymer core even when the fabric is exposed to a temperature that is higher than the melting point of the lower melting polymer, thereby retaining the physical integrity and expanding the use temperature range of the fabric. Alternatively stated, unlike a monocomponent fiber fabric that is produced from the lower melting polymer of the conjugate fibers, which will melt and lose the dimensional integrity, the present conjugate fiber fabric largely retains its dimensional and tactile properties when the fabric is exposed to a temperature higher than the melting point of the lower melting polymer component of the conjugate fibers. In addition, it has surprisingly been found that the conjugate fiber fabric does not reduce its softness and hand as much as conjugate fiber fabrics produced from conjugate fibers having the lower melting polymer sheath and the higher melting polymer core when the fabric is annealed or exposed to a temperature that melts and/or promotes further crystallization of the lower melting polymer.

Furthermore, it has been found that nonwoven fabrics produced from the present conjugate fibers exhibit a widened bonding window with respect to abrasion resistance of the fabric, i.e., an expanded temperature range in which a nonwoven fabric can be bonded to provide a suitable level of abrasion resistance, when compared to pattern bonded nonwoven fabrics that are produced from monocomponent fibers containing the individual component polymer of the conjugate fibers. The widened bonding window result is highly unexpected in that the conjugate fibers, which have the peripheral surface completely enclosed by the higher melting component polymer, are expected at best to have a bonding window that is similar to a monocomponent fiber web produced from the high melting component polymer since, as discussed above, bond points are formed by fusing the polymer of the fibers, especially at the surface of the fibers.

The component polymers of the higher melting component polymers for the conjugate fibers are selected from olefin polymers, polyamides, polyesters and blends and copolymers thereof. Desirably, the higher melting component polymer has a melting point at least about 5° C., more desirably at least about 10° C., higher than the other component polymers of the fibers. Olefin polymers suitable for the conjugate fibers include polyethylene, e.g., high density polyethylene, medium density polyethylene, low density polyethylene and linear low density polyethylene; polypropylene, e.g., isotactic polypropylene, syndiotactic polypropylene, blends thereof, and blends of isotactic polypropylene and atactic polypropylene; polybutylene, e.g., poly(1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene copolymers. Polyamides suitable for the conjugate fibers include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include poly(ethylene terephthalate), poly(buthylene terephthalate), poly(tetramethylene terephthalate), polycyclohexylene-1,4-dimethylene terephthalate), and isophthalate copolymers thereof, as well as blends thereof. Of these suitable polymers, the more desirable polymers of the higher melting component are polyolefins, most desirably polyethylene and polypropylene, because of their commercial availability and importance, as well as their chemical and mechanical properties.

The lower melting component polymers of the conjugate fibers are selected from olefin homopolymers, olefin copolymers and blends thereof. Suitable olefin polymers for the low melting polymer component are selected from the olefin polymers listed above for the higher melting component polymer of the conjugate fibers provided that the selected olefin polymer has a lower melting point than the higher melting component polymer, desirably in accordance with the above-described desirable melting temperature difference range. The most desirable polyolefins are polyethylene, polypropylene, and blends and copolymers thereof because of their commercial importance and their desirable chemical and mechanical properties. The present conjugate fibers may have any suitable weight combination of the higher and lower melting component polymers provided that the fibers contain sufficient amount of the higher melting polymer to enclose the lower melting polymer. Desirably, when bicomponent conjugate fibers are utilized, the conjugate fibers contain, based on the total weight of the fiber, up to about 85%, specifically between about 10% and about 85%, more specifically between about 20% and about 75%, even more specifically between about 30% and 65%, of a lower melting component polymer.

In accordance with the present invention, the conjugate fibers of the present invention may have any conjugate fiber configuration provided that the higher melting component polymer forms and encloses the peripheral surface of the fibers along substantially the entire length of the fibers. Suitable conjugate fiber configurations include concentric and eccentric sheath-core configurations and island-in-sea configurations, and the conjugate fibers may be crimped or uncrimped.

In general, the conjugate fibers are produced by melt-processing the component polymers. The component polymers are melt-processed in separate extruders, which melt the polymers and ensure that each polymer melt has a uniform flow consistency. The melted component polymers are led from the extruders and passed through the spinning holes of a conjugate fiber spinneret. A suitable conjugate fiber spinneret, for example, is disclosed in U.S. Pat. No. 4,717,325 to Fujimura et al. In staple fiber production processes, the melt-spun filaments are quenched and solidified, typically, by a stream of air and then stretched or drawn by a series of hot rollers after or while the filaments are heated to an appropriate temperature. The drawn filaments are then textured and cut to a staple length. Subsequently, the staple fibers are subsequently deposited, e.g., carded, or air or wet laid, on a forming surface to form a nonwoven web and then bonded. In continuous filament production processes, e.g., spunbond process, the melt-spun filaments are drawn while being quenched, typically, by a stream of pressurized air and then solidified to form continuous drawn filaments. The drawn filaments are directly deposited on a forming surface and then bonded to form a nonwoven fabric. An exemplary process for producing highly suitable conjugate fibers for the present invention is disclosed in commonly assigned U.S. Pat. No. 5,382,400 to Pike et al., which in its entirety is herein incorporated by reference. Briefly, the patent discloses a process for producing a spunbond conjugate fiber web, which includes the steps of melt-spinning continuous multicomponent polymeric filaments, at least partially quenching the multicomponent filaments so that the filaments have latent crimpability, activating the latent crimpability and drawing the filaments by applying heated drawing air, and then depositing the crimped, drawn filaments onto a forming surface to form a nonwoven web. In general, a higher drawing air temperature results in a higher number of crimps. Optionally, during the drawing step, unheated ambient air can be used to suppress the activation of the latent crimpability and to produce uncrimped conjugate fibers.

The nonwoven webs formed from the conjugate fibers are bonded using any suitable pattern bond forming process. Generally, a desirable pattern bonding process employs pattern bonding roll pairs for effecting bond points at limited areas of the web by passing the web through the nip formed by the bonding rolls. One or both of the roll pair have a pattern of lands and depressions on the surface, which effects the bond points, and are heated to an appropriate temperature as further discussed below. Alternatively, the bond pattern can be applied by passing the web through a gap formed by an ultrasonic work horn and anvil.

The temperature of the bonding rolls and the nip pressure should be selected so as to effect bonds without having undesirable accompanying side effects such as excessive shrinkage and web degradation. In addition, the bonding roll temperature should not be so high as to cause the fabric to stick to the bonding rolls. Alternatively stated, it is not desirable to expose the web to a temperature at which extensive fiber melting occurs, thereby thermally degrading the fabric and allowing the fabric to stick to the bonding rolls. Although appropriate roll temperatures and nip pressures are generally influenced by parameters such as web speed, web basis weight, fiber characteristics, component polymers and the like, the roll temperature desirably is in the range between the softening point and the crystalline melting point of the component polymer that forms the peripheral surface of the conjugate fibers. For example, desirable bonding settings for nonwoven webs which contain the conjugate fibers that have polypropylene as the higher melting component polymer are a roll temperature in the range of about 125° C. and about 160° C. and a pin pressure on the fabric in the range of about 350 kg/cm$^2$ and about 3,500 kg/cm$^2$.

Materials suitable for producing bonding rolls are known in the art. For example, steels are suitable for pattern rolls, and high temperature rubbers are suitable for smooth rolls. Suitable pattern roll forming procedures are known in the engraving art. In accordance with the present invention, the total area covered by the bond points occupies between about 3% and 50%, desirably about 4% to about 45%, more preferably about 5 to about 35%, of the planar surface of the bonded nonwoven fabric, and the bonded nonwoven fabric contains desirably from about 8 to about 120 bonded points per square centimeter (cm$^2$), more preferably from about 12 to about 100 bonded points per cm$^2$.

The conjugate fiber nonwoven fabric of the present invention is soft, drapable and low-linting and exhibits good hand while substantially maintaining the abrasion resistance and scuff resistance of similarly prepared monocomponent fiber nonwoven fabrics that are produced from the higher melting component polymer of the conjugate fibers. Moreover, nonwoven fabrics produced from the present conjugate fibers have a widened bonding window and an expanded use temperature range when compared to nonwoven fabric prepared from monocomponent fibers containing each of the component polymers of the conjugate fibers. The soft, drapable nonwoven fabric is highly suitable for use in various applications where softness, drapability and abrasion resistance are important. For example, the conjugate fiber nonwoven fabric is highly suitable for disposable articles including surgical drapes; liners for diapers, sanitary napkins and incontinence care products; disposable garments, e.g., protective garments, surgical gowns and examining gowns; and the like. The soft, drapable nonwoven fabric may be used as a single layer material or as a laminate that contains at least one layer of the nonwoven fabric and at least one additional layer of a nonwoven fabric or film. The additional layer for the laminate is selected to impart additional and/or complementary properties, such as liquid and/or microbe barrier properties. For example, a highly useful laminate structure is disclosed in U.S. Pat. No. 4,041,203 to Brock et al., which is herein incorporated by reference. The patent discloses a laminate of a continuous filament nonwoven web, e.g., spunbond web, and a microfiber nonwoven web, e.g., meltblown web.

Disposable garments that can be produced from the present nonwoven fabrics are disclosed, for example, in U.S. Pat. No. Nos. 3,824,625 to Green and 3,911,499 to Benevento et al., which patents are herein incorporated by reference. For example, as shown in FIG. 1, a gown 10 has a body portion 12, a pair of sleeves 14, which optionally have cuffs 16, and a neck opening 18. The body portion 12, which desirably is produced from the present conjugate fiber nonwoven fabric, has a continuous front side 20 and a back side containing left and right panels 22 and 24. Attached to the right panel 24 is a overlapping flap 26 extending substantially the full length of the gown and which is shown in a folded position in FIG. 1. The left panel 22 and the flap 26 can be secured together by means of attaching strips 28 and 38 that are affixed to the panel and the flap, respectively. The attaching strips can be elongated straps that can be manually tied or self attaching strips. Suitable self attaching strips include adhesive strips and mechanical securing means, for example, a hook and loop attachment, such as a Velcro® fastener system. The cuffs 16 can be fabricated from a wide variety of stretchable woven and nonwoven materials. The cuffs can be formed from a stretchable knit fabric or an elasticized or elastic nonwoven fabric. For example, a suitable nonwoven cuff is disclosed in U.S. Pat. No. 3,727,239 to Thompson. The cuffs 16 can be adhesively, thermally or mechanically attached to the sleeves 14. The disposable gown provides highly desirable hand, softness and drapability, while providing excellent abrasion and scuff resistance, making it highly suitable as examining gowns, surgical gowns and the like.

The following examples are provided for illustration purposes and the invention is not limited thereto.

EXAMPLES

The following test procedures were used determine various physical properties of the nonwoven fabrics of the following examples.

Tensile Load

The tensile load strength was tested in accordance with Federal Standard Methods 191A, Method 5100 (1978), the Grab Tensile Test. The test measures the load at the point of strain break of a test fabric.

Cup Crush Load

The cup crush test measurements, which evaluate stiffness of a fabric, are determined on a 9"×9" square fabric which is placed over the top of a cylinder having an opening approximately 5.7 cm in diameter and 6.7 cm in length, and fashioning the fabric into an inverted cup shape by sliding a hollow cylinder having an inside diameter of about 6.4 cm over the fabric covering the cylinder. The inside cylinder is then removed, and the top flat portion of the unsupported, inverted cup-shaped fabric contained in the hollow cylinder is placed under a 4.5 cm diameter hemispherically shaped foot. The foot and the cup shaped-fabric are aligned to avoid contact between the wall of the hollow cylinder and the foot which might affect the load. The peak load, which is the maximum load required while crushing the cup-shaped fabric test specimen, is measured while the foot descends at a rate of about 0.25 inches per second (15 inches per minute) utilizing a Model FTD-G-500 load cell (500 gram range), which is available from the Schaevitz Company, Tennsauken, N.J. A lower value in the cup crush test measurement indicates a softer material.

Martindale Abrasion

The abrasion resistance test was conducted on a Martindale Wear and Abrasion Tester Model No. 103 from Ahiba-Mathis, Charlotte, N.C., in accordance with the ASTM D4966-89 abrasion testing procedure using an applied pressure of 9 kPa. The samples were subjected to 120 cycles and then examined for the presence of surface fuzzing, pilling, roping and holes. The samples were compared to a visual scale and assigned a wear number from 1 to 5 with 5 indicating little or no visible abrasion and 1 indicating a hole worn through the sample.

Examples 1–12

(Ex1–Ex12)

Approximately 1 ounce per square yard (osy), 34 g/m$^2$, spunbond nonwoven webs were prepared from sheath-core bicomponent fibers of linear low density polyethylene (LLDPE) and polypropylene (PP) using the bicomponent conjugate fiber production process disclosed in the above-mentioned U.S. Pat. No. 5,382,400, and unheated ambient air was used as drawing air. LLDPE, Aspun 6811A, which is available from Dow Chemical, was blended with 2 wt % of a $TiO_2$ concentrate containing 50 wt % of $TiO_2$ and 50 wt % of a PP, and the mixture was fed into a first single screw extruder. PP, PD3443, which is available from Exxon, was blended with 2 wt % of the above-described $TiO_2$ concentrate, and the mixture was fed into a second single screw extruder. The extruded polymers were spun into bicomponent fibers using a concentric sheath-core bicomponent spinning die, which had a 0.6 mm spinhole diameter and a 6:1 L/D ratio. The temperature of the molten polymers fed into the spinning die was kept at 229° C., and the spinhole throughput rate was 0.7 gram/hole/minute. The PP extrudate was fed through the die to form the sheath of the fibers, and the LLDPE extrudate was fed through the die to form the core. The ratio of the two polymer extrudates fed into the spinning die was controlled to produce bicomponent fibers having different component polymer weight ratios. The percentage weight contents of the component polymers for the example fabrics are indicated in Table 1. The bicomponent fibers exiting the spinning die were quenched by a flow of air having a flow rate of 3.2 m$^3$/min/cm (45 ft$^3$/min/inch) spinneret width and a temperature of 18° C. The quenching air was applied about 13 cm below the spinneret, and the quenched fibers were drawn in an aspirating unit of the type which is described in U.S. Pat. 3,802,817 to Matsuki et al. The weight-per-unit-length measurement of the drawn fibers was about 2 denier per filament. The drawn fibers were then deposited on a foraminous forming surface with the assist of a vacuum flow to form an unbonded fiber web.

The unbonded fiber web was bonded by passing the web through the nip formed by a calender roll and an anvil roll. The calender roll was a steel roll which had a patterned configuration of regularly spaced raised points (bonding points) on its surface and was equipped with a heating means. The anvil roll was a smooth stainless steel roll and was also equipped with a heating means. Both of the bonding rolls had a diameter of about 61 cm. The bonding pin pressure applied by the bonding rolls on the webs was about 560 kg/cm$^2$, and the rolls were heated to a temperature as indicated in Table 1. The total bonded area of the fabrics occupied about 25% of the total surface area.

Comparative Examples 1–4

(C1–C4)

Polypropylene fiber nonwoven fabrics were produced in accordance with the procedure outlined in Example 1, except polypropylene, PD3443, was fed into both of the extruders. The polypropylene fiber nonwoven fabrics were bonded at bonding temperatures as indicated in Table 1.

TABLE 1

| Example | Polymer* PP (%) | LPE (%) | HPE | Basis Weight ($g/m^2$) | Bonding Temperature (°C.) | Tensile Load** MD (kg) | Cup Crush Load** (g) | Martindale Abrasion |
|---|---|---|---|---|---|---|---|---|
| Ex1 | 35 | 65 | — | 37.5 | 120 | 7.0 | 91 | 3.8 |
| Ex2 | 50 | 50 | — | 37.6 | 120 | 5.7 | 114 | 1.8 |
| Ex3 | 80 | 20 | — | 42.6 | 120 | 5.3 | 138 | 1.8 |
| C1 | 100 | — | — | 39.0 | 123 | 4.1 | 154 | 1.0 |
| Ex4 | 35 | 65 | — | 37.6 | 134 | 7.0 | 121 | 5.0 |
| Ex5 | 50 | 50 | — | 37.6 | 134 | 10.0 | 133 | 5.0 |
| Ex6 | 80 | 20 | — | 41.7 | 134 | 10.3 | 167 | 4.8 |
| C2 | 100 | — | — | 39.0 | 136 | 9.8 | 182 | 2.8 |
| Ex7 | 35 | 65 | — | 39.3 | 143 | 6.8 | 129 | 5.0 |
| Ex8 | 50 | 50 | — | 39.7 | 143 | 8.2 | 160 | 5.0 |
| Ex9 | 80 | 20 | — | 40.5 | 143 | 12.4 | 192 | 5.0 |
| C3 | 100 | — | — | 40.4 | 141 | 15.3 | 183 | 5.0 |
| Ex10 | 35 | 65 | — | 38.7 | 148 | 7.0 | 159 | 5.0 |
| Ex11 | 50 | 50 | — | 39.6 | 148 | 7.8 | 177 | 5.0 |
| Ex12 | 80 | 20 | — | 41.7 | 148 | 12.3 | 226 | 5.0 |
| C4 | 100 | — | — | 40.0 | 152 | 12.3 | 230 | 5.0 |
| C5 | 50 | 50 | — | 32.9 | 107 | 6.8 | 47 | 1 |
| C6 | 50 | 50 | — | 33.6 | 117 | 10.6 | 55 | 4 |
| C7 | 50 | 50 | — | 33.2 | 122 | 11.6 | 60 | 3 |
| C8 | 50 | — | 50 | 33.9 | 105 | 3.4 | 53 | 1 |
| C9 | 50 | — | 50 | 33.9 | 117 | 9.8 | 57 | 1 |
| C10 | 50 | — | 50 | 35.3 | 126 | 11.7 | 68 | 2.4 |

*LPE = LLDPE
HPE = HDPE
**Tensile Load and Cup Crush Load values are linearly normalized to 1 33.9 $g/m^2$ (1 OSY) basis weight.

The results of Examples 1–2 and Comparative Example 1 demonstrate that nonwoven fabrics containing the conjugate fibers having the lower melting polymer core exhibit improved abrasion resistance and tensile strength over a polypropylene fiber web even at the low bonding temperature of 120° C., indicating that the present conjugate fiber webs have a widened bonding window. The low tensile load and abrasion resistance values of the polypropylene fiber fabric demonstrate that the bonding temperature is not high enough to properly bond polypropylene fibers, producing an underbonded fabric.

Examples 4–6 and Comparative Example 2 demonstrate that the abrasion resistance of the present conjugate fiber nonwoven fabric surprisingly attains highly desirable abrasion resistance even at a bonding temperature that is not sufficiently high enough to produce a polypropylene fiber web having good abrasion resistance, i.e., the polypropylene fabric is underbonded. It is to be noted that the low cup crush load values of Examples 4–6, compared to the value of Comparative Example 2, indicate that the conjugate fiber fabrics are also softer and more drapable than the underbonded polypropylene fiber web, Comparative Example 2.

Figure 2:
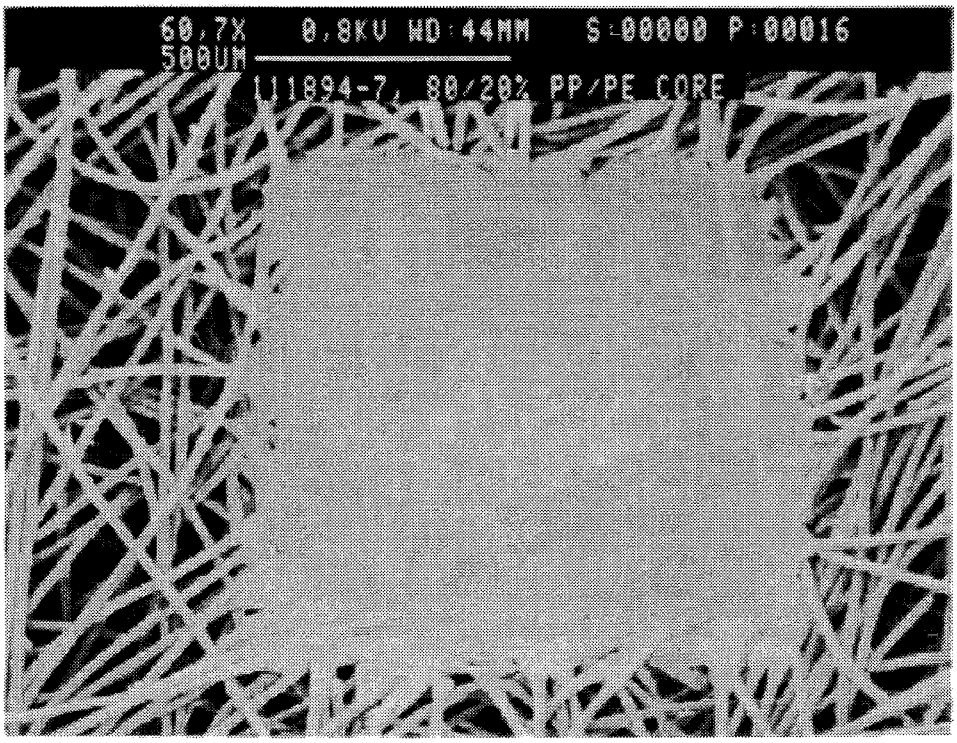
FIG. 2 is a microphotograph of a bond point of a nonwoven fabric containing the conjugate fibers of the present invention.
Figure 3:
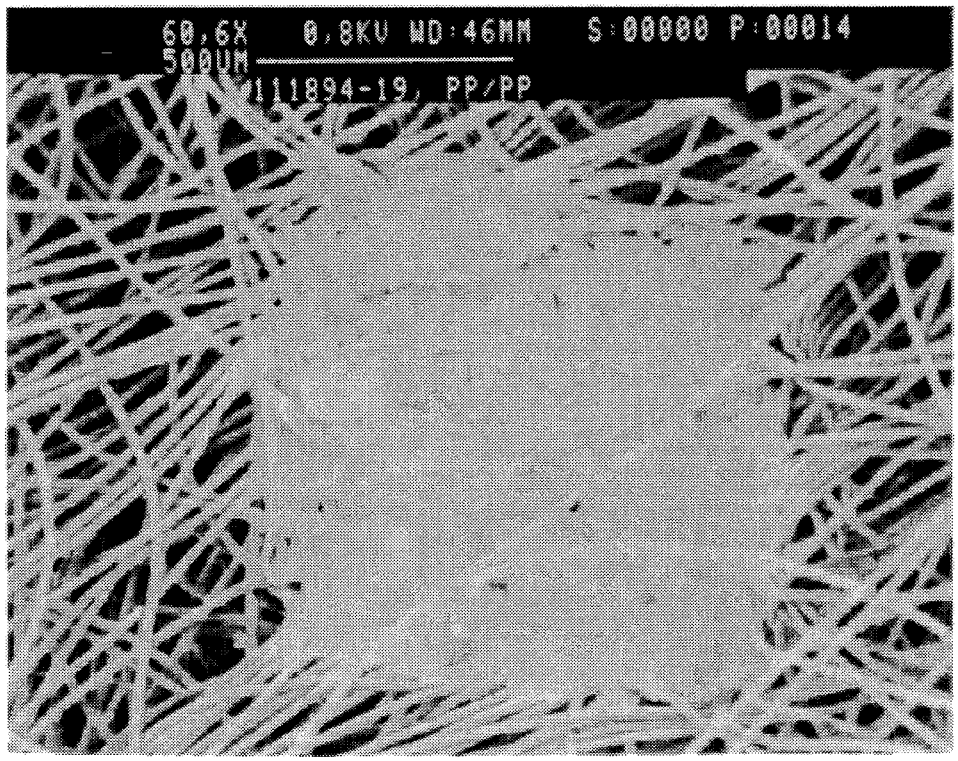
FIG. 3 is a microphotograph of a bond point of a nonwoven fabric containing polypropylene fibers.
Figure 4:
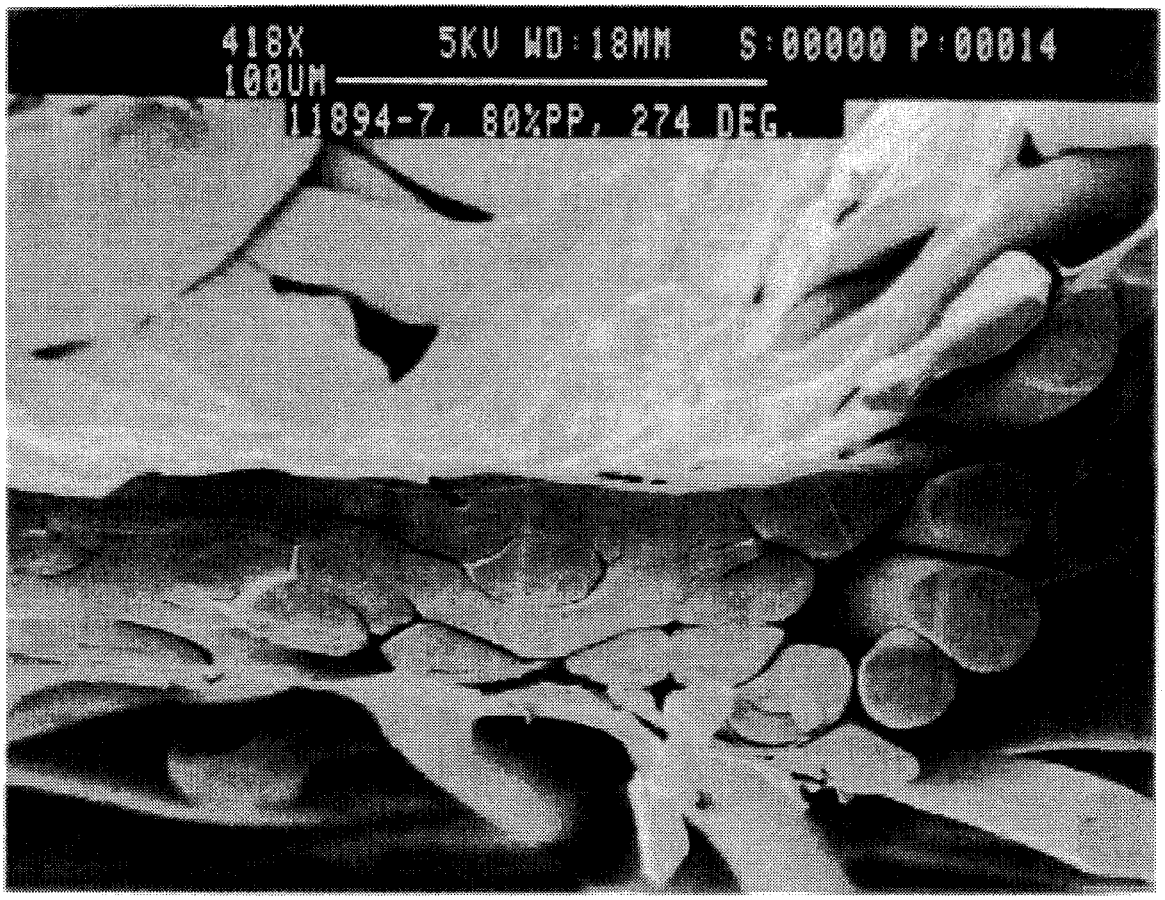
FIG. 4 is a micrograph of a highly magnified view of a bond point of a conjugate fiber nonwoven fabric of the present invention.

Turning to the figures, FIG. 2 is an about 61 times magnified micrograph of the fabric of Example 6, which shows a bond point of the fabric; FIG. 3 is an about 61 times magnified micrograph of the fabric of Comparative Example 2, which shows a bond point of the fabric; and FIG. 4 is an about 420 times magnified micrograph of the cross-section of a bond point of the fabric of Example 6. The bond points shown in FIGS. 2 and 3 were imparted using the same bonding process, and the only difference in the bonding parameters was that the fabric of Comparative Example 2 was bonded at a temperature merely 2° C. higher than that of the fabric of Example 6. FIG. 2, compared to FIG. 3, shows a bond point that is well defined and has a smooth, less fibrous surface, clearly demonstrating that the present conjugate fibers provides more evenly and thoroughly bonded bond points. A further magnified cross-sectional view, FIG. 4, of a bond point of the fabric of Example 6 was made to analyze the smooth, less fibrous bond surface. As can be seen from FIG. 4, the flattened and fused conjugate fibers at the bond point retained the sheath/core configuration, i.e., the core is completely enclosed by the sheath even in the flattened state. Consequently, the improvement in the bond points is not directly attributable to the core component polymer in that the core polymer does not directly participate in the formation of the bond points.

Examples 7–12 and Comparative Examples 3–4 illustrate that the present conjugate fiber fabric responds similarly to the bonding temperature range that is suitable for polypropylene fiber webs, providing similarly high abrasion resistance.

The above results indicate that the conjugate fiber web of the present invention has an expanded bonding window, especially with respect to abrasion resistance, and improved softness and drapability when compared to a monocomponent fiber fabric produced from the higher melting polymer.

Comparative Examples 5–7

(C5–C7)

Conventional LLDPE sheath/PP core conjugate spunbond fiber webs were produced in accordance with Example 1, except the PP composition was processed in the first single screw extruder and the LLDPE composition was processed in the second single screw extruder. The spinning die was kept at about 221° C. The bonding temperature for each example is shown in Table 1. The LLDPE sheath/PP core conjugate fiber web could not be bonded a temperature significantly higher than the bonding temperature of Comparative Example 7 since the melting point of LLDPE was about 125° C. The results are shown in Table 1. It is to be noted that Comparative Example 5, which was bonded at 107° C., had the Martindale abrasion value of 1, indicating that the fabric was underbonded at that temperature, and that the abrasion resistance of the fabric appeared to level off at the bonding temperature of around 117° C., Comparative Example 7. It is also to be noted that Comparative Examples 5–7 did not attain the Martindale abrasion value of 5, demonstrating that the lower melting point polymer sheath/higher melting point polymer core fiber nonwoven fabric does not have high abrasion resistance. The results demonstrate that nonwoven fabrics having lower melting polymer sheath/high melting polymer core conjugate fibers have a narrow bonding window. Comparative Examples 8–10 (C8–C10)

High density polyethylene sheath/PP core conjugate spunbond fiber webs were produced in accordance with Comparative Example 5, except high density polyethylene (HDPE) was used in place of LLDPE. HDPE was obtained from Exxon, Escorene HD6705.19 HDPE. The bonding temperature for each example is shown in Table 1. Again, the HDPE sheath/PP core conjugate fiber web could not be bonded a temperature significantly higher than the bonding temperature of Comparative Example 10 since the melting point of HDPE is about 130° C. The results are shown in Table 1. Again, Comparative Examples 8–10 demonstrate that polyethylene sheath/polypropylene core conjugate fiber fabrics have a narrow bonding window and do not provide as high levels of abrasion resistance and have a limited bonding window temperature range.

Examples 13–14

(Ex13–Ex14)

The nonwoven fabrics of Example 5 and Example 8, Examples 13 and 14 respectively, were annealed at a temperature higher than the melting point of the polyethylene component in order to demonstrate the heat stability and the expanded use temperature range of the present nonwoven fabric. The nonwoven fabrics were placed in a hot air convection oven, which was kept at about 151° C., for 60 minutes. The annealed fabrics and corresponding pre-annealed fabrics were tested for the cup crush load. The results are shown in Table 2.

Comparative Example 11

(C11)

The annealing and testing procedures outlined in Example 13 were repeated with the fabric of Comparative Example 6 (LLDPE sheath/PP core fiber). The results are shown in Table 2.

TABLE 2

| | Cup Crush Load (g) | | |
|---|---|---|---|
| Example | Pre-Annealed | Annealed | % Increase |
| Ex13 | 149 | 189 | 27% |
| Ex14 | 187 | 206 | 10% |
| C11 | 54 | 379 | 702% |

As can be seen from the cup crush load data, the present conjugate fiber fabric does not significantly change its softness even when annealed at a temperature that is significantly higher than the melting point of LLDPE. The results demonstrate that the present conjugate fiber fabric can be utilized in applications in which the fabric is exposed to a temperature higher than the melting point of the lower melting component polymer of the conjugate fibers. In contrast, the conventional conjugate fiber web, Comparative Example 11, increased its stiffness more than 7 times of its original value, indicating that physical properties of the fabric drastically changed during the annealing process.

Figure 5:
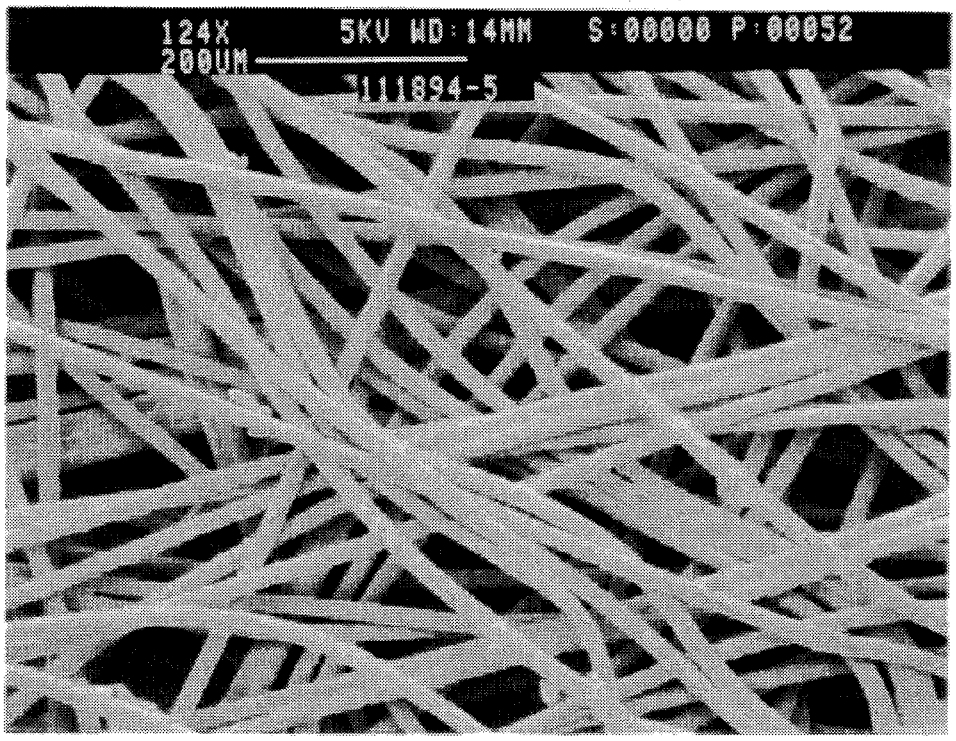
FIG. 5 is a microphotograph of an exemplary conjugate fiber fabric of the present invention that was heat treated at a temperature which is higher than the melting point of the lower melting component of the conjugate fibers.
Figure 6:
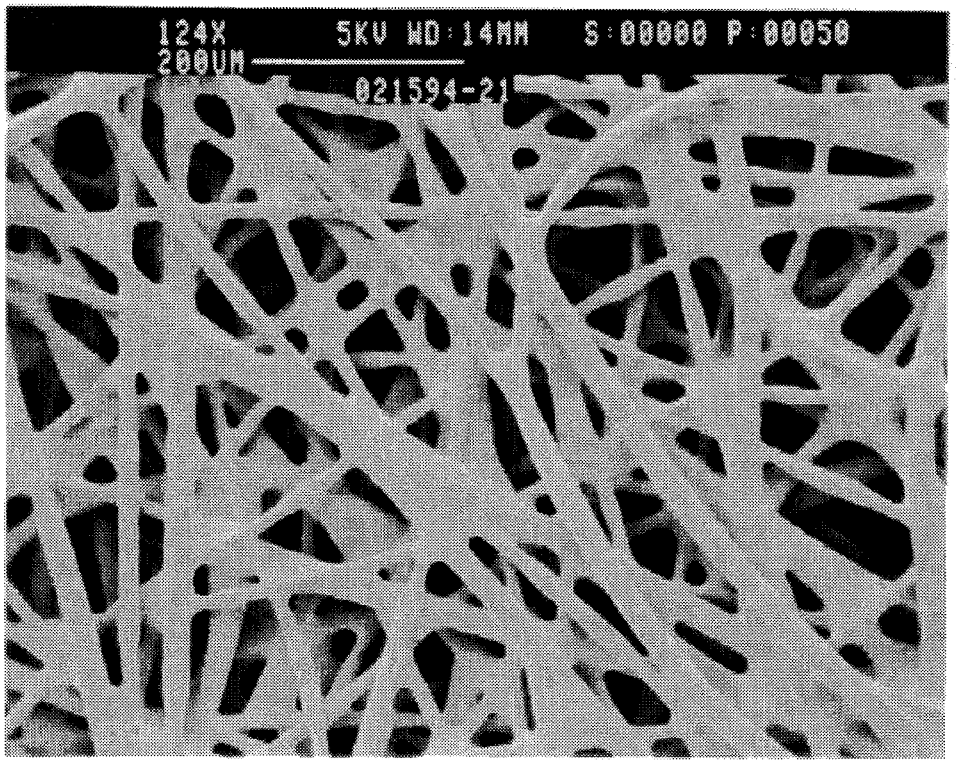
FIG. 6 is a microphotograph of a heat treated conventional conjugate fiber fabric that contains low melting polymer sheath/high melting polymer core conjugate fibers. The fabric was heat treated at a temperature that is higher than the melting point of the sheath polymer.

Turning to the figures, FIG. 5 is a magnified view of the annealed fabric of Example 13 and FIG. 6 is a magnified view of the annealed fabric of Comparative Example 11. Comparing FIGS. 5 and 6 clearly demonstrates that the sheath component of the fabric of Comparative Example 11 was melted and spread during the annealing process, changing physical properties of the fabric. In contrast, the conjugate fibers of the present fabric, FIG. 5, did not change their fibrous configuration during the annealing process, making the soft fabric highly useful even in the temperature range that is higher than the melting point of the lower melting component polymer.

The above examples clearly illustrate that the conjugate fiber fabric of the present invention is a soft nonwoven fabric that has highly useful abrasion and scuff resistances as well as a widened bonding window and an expanded use temperature range.

What is claimed is:

1. A pattern bonded nonwoven fabric comprising conjugate fibers, said conjugate fibers comprising a higher melting point component polymer and a lower melting point component polymer, wherein said higher melting component polymer envelops said lower melting component polymer and forms the peripheral surface along the length of said fibers.

2. The nonwoven fabric of claim 1 wherein said conjugate fibers have a conjugate fiber configuration selected from sheath/core and island-in-sea configurations.

3. The nonwoven fabric of claim 2 wherein said conjugate fibers have a sheath/core configuration.

4. The nonwoven fabric of claim 1 wherein said higher melting polymer is selected from olefin polymers, polyamides, polyesters and blends thereof; and said lower melting polymer is selected from olefin polymers.

5. The nonwoven fabric of claim 2 wherein said conjugate fibers are spunbond fibers.

6. A bonded nonwoven fabric comprising conjugate fibers, said conjugate fibers comprising a higher melting point component polymer, which is selected from olefin polymers, polyamides, polyesters and blends thereof; and a lower melting point component polymer, which is selected from olefin polymers, wherein said higher melting component polymer envelops said lower melting component polymer and forms the peripheral surface along the length of said fibers, and said nonwoven fabric is pattern bonded.

7. The nonwoven fabric of claim 6 wherein said conjugate fibers have a conjugate fiber configuration selected from sheath/core and island-in-sea configurations.

8. The nonwoven fabric of claim 7 wherein said conjugate fibers have a sheath/core configuration.

9. The nonwoven fabric of claim 6 wherein said conjugate fibers are spunbond fibers.

10. The nonwoven fabric of claim 6 wherein said olefin polymers are selected from polyethylene, polypropylene, polybutylene, and blends and copolymers thereof.

11. The nonwoven fabric of claim 6 wherein said higher melting polymer and lower melting polymer are selected from olefin polymers.

12. The nonwoven fabric of claim 11 wherein said higher melting polymer is polypropylene and lower melting polymer is polyethylene.

13. The nonwoven fabric of claim 11 wherein said conjugate fibers comprise up to about 85% of said lower melting polymer based on the total weight of said fibers.

14. A disposable article comprising a pattern bonded nonwoven fabric comprising conjugate fibers, said conjugate fibers comprising a higher melting point component polymer, which is selected from olefin polymers, polyamides, polyesters and blends thereof; and a lower melting point component polymer, which is selected from olefin polymers, wherein said higher melting component polymer envelopes said lower melting component polymer and forms the peripheral surface along the length of said fibers.

15. The disposable article of claim 14 wherein said conjugate fibers have a sheath/core configuration and are spunbond fibers.

16. The disposable article of claim 14 wherein said olefin polymers are selected from polyethylene, polypropylene, polybutylene, and blends and copolymers thereof.

17. The disposable article of claim 14 wherein said higher melting polymer and lower melting polymer are selected from olefin polymers.

18. The disposable article of claim 14 wherein said higher melting polymer is polypropylene and lower melting polymer is polyethylene.

19. The disposable article of claim 14 is a surgical drape, a liner, or a disposable garment.

20. The disposable article of claim 19 is a disposable garment selected from examining gowns, surgical gowns and protective garments.

* * * * *

UNITED STATES PATENT AND TRADEMARK OFFICE

CERTIFICATION OF CORRECTION

PATENT NO. : 5,545,464

DATED : August 13, 1996

INVENTOR(S): Ty J. Stokes

It is certified that the following errors appear in the above-identified patent and that said Letters Patent is hereby corrected as shown below:

Column 6, line 57, "Pat. No. Nos." should read --Pat. Nos.--;

Column 9, table 1, line 26, "1 33.9 g/m$^{2}$" should read --a 33.9 g/m$^{2}$--.

Column 11, line 8, "Comparative Examples 8-10" should be written as a paragraph heading.

Signed and Sealed this

Twenty-eighth Day of January, 1997

*Attest:*

Bruce Lehman

BRUCE LEHMAN

*Attesting Officer* *Commissioner of Patents and Trademarks*